United States Patent [19]

Kaufmann

[11] 4,096,774

[45] Jun. 27, 1978

[54] TURRET PUNCHES

[75] Inventor: Harold Kaufmann, Rochester, Minn.

[73] Assignee: Houdaille Industries, Inc., Buffalo, N.Y.

[21] Appl. No.: 698,474

[22] Filed: Jun. 21, 1976

[51] Int. Cl.[2] ..... B26F 1/14

[52] U.S. Cl. ..... 83/552; 83/691; 83/698

[58] Field of Search ..... 83/552, 690, 691, 687, 83/698, 162, 164–166

[56] References Cited

U.S. PATENT DOCUMENTS

| | | | |
|---|---|---|---|
| 1,876,285 | 9/1932 | Froussard | 83/552 X |
| 2,017,247 | 10/1935 | Hodge | 83/686 X |
| 3,165,962 | 1/1965 | Bredow | 83/552 X |
| 3,527,130 | 9/1970 | Knehans | 83/552 X |
| 3,951,026 | 4/1976 | Beauplat | 83/552 |

*Primary Examiner*—J. M. Meister

*Attorney, Agent, or Firm*—Hill, Gross, Simpson, Van Santen, Steadman, Chiara & Simpson

[57] ABSTRACT

A machine tool, such as a turret punch, having one or more individual tools positioned in a tool holder member attachable to the turret and easily removable therefrom whereby tools are changed by changing turret tool holder members rather than by changing the individual tool.

14 Claims, 13 Drawing Figures

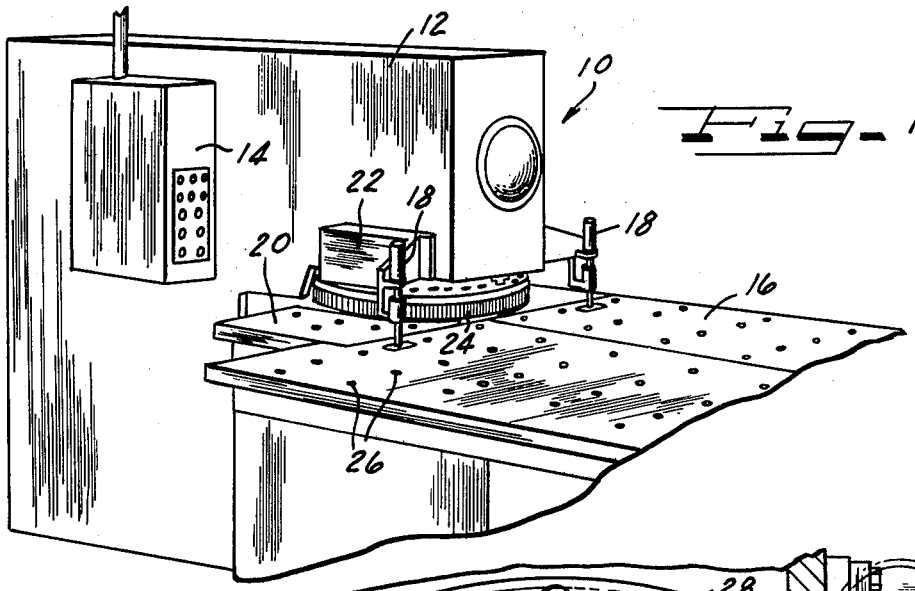
Fig. 1
Fig. 2
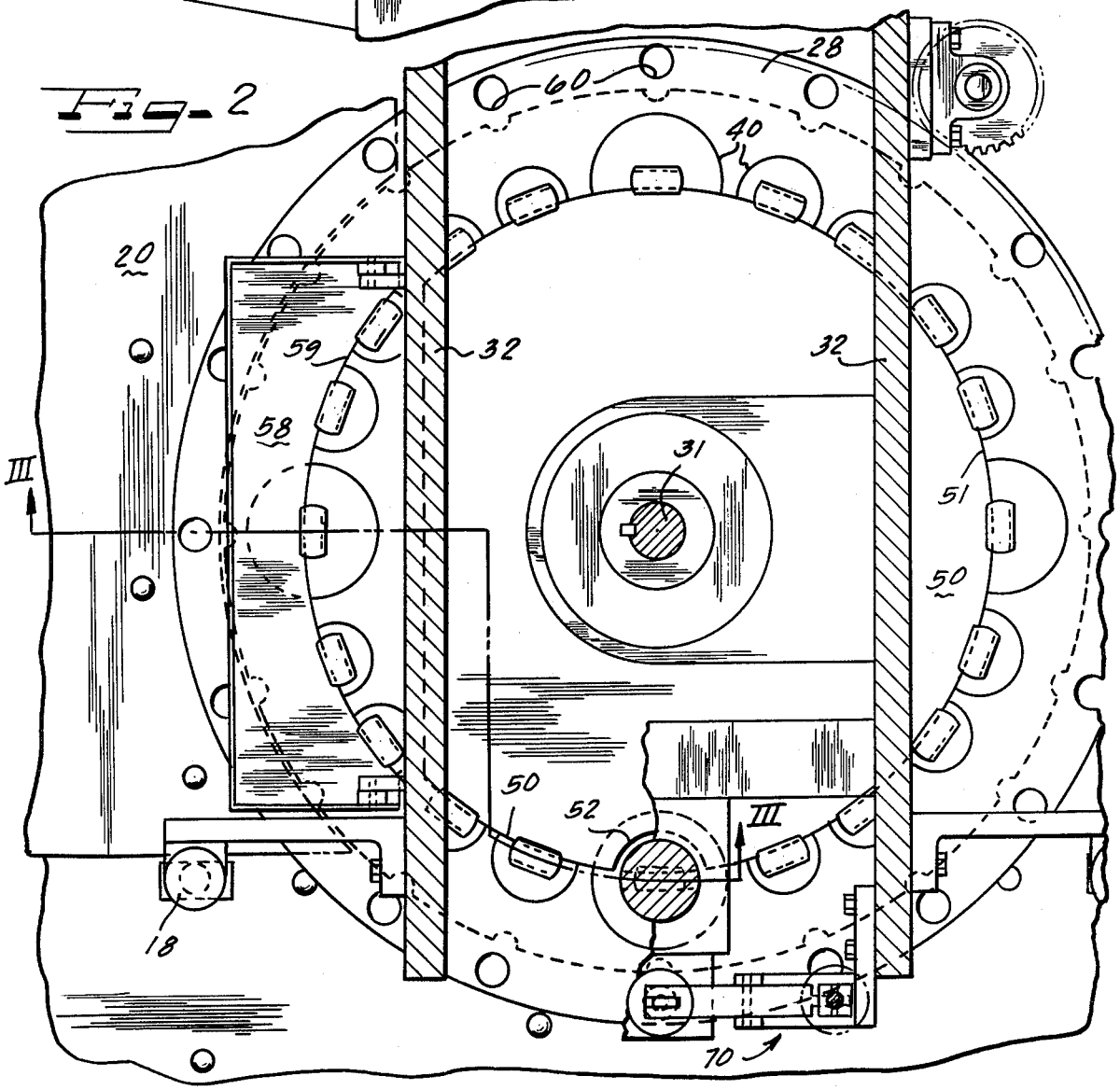

22
56
32
230
58
34
46
50
48
47
42
36
44
35
28
40
20
201
203
38
202
200
114
270
102
203
30
104
104

251
141
114
38
260
257
30

70
72
32
74
78

80
76

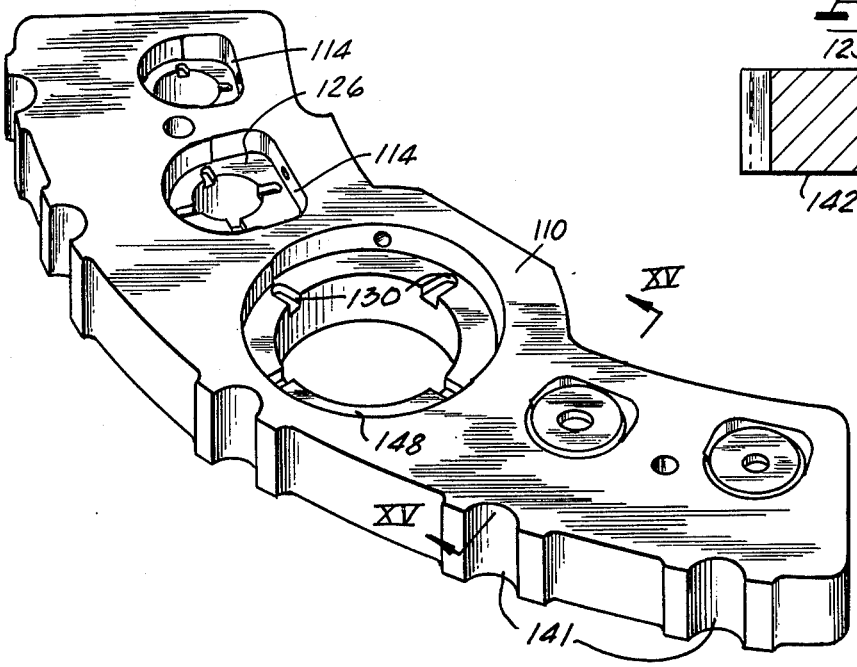
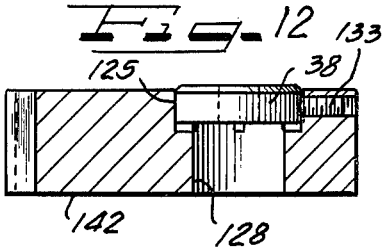
Fig. 12
Fig. 11
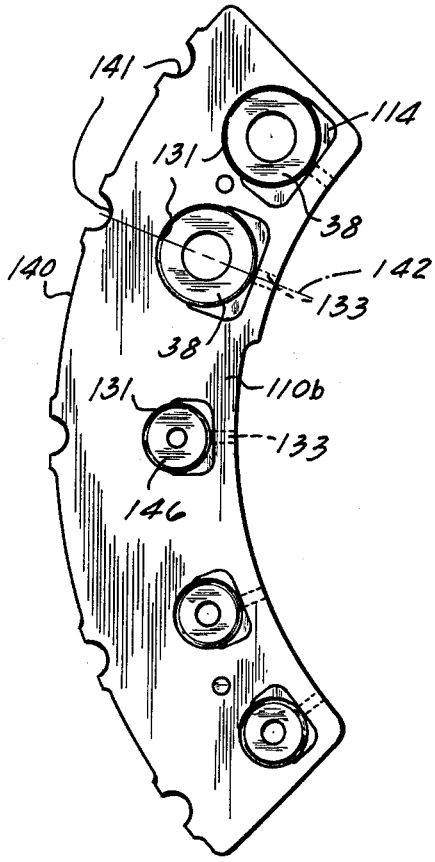
Fig. 13

TURRET PUNCHES

BACKGROUND OF THE INVENTION

1. Field of the Invention

This invention relates to machine tools and more particularly to tool carrying turret equipped machine tools.

2. Prior Art

There is a recognized sub-branch of machine tools wherein the overall machine is equipped with turrets which carry a plurality of individual tools. One specific example of this type of mechanism is found in the punch art wherein an individual punch machine will be equipped with upper and lower turrets. The upper turret is generally provided with a ring-like tool carrying area and is carried on a central rotatable shaft. The ring area has a plurality of openings therethrough which receive punches. The punches are generally positioned in punch holders. The lower turret also includes a tool carrying ring area and is mounted on a central shaft and rotatable with respect to the machine. The ring area of the lower turret is also equipped with a plurality of apertures therethrough each of which is designed to be aligned with a die carried by the lower turret. As the turrets are rotated in unison, vertically aligned punches and dies are presented at a ram station where a ram acts upon the punch to urge it towards and into the die. Because each turret carries a plurality of tools, it is not necessary to move the work piece from one machine to another when different tool combinations consisting of an aligned punch and coopertively sized die are to be successively used. An example of such a machine is shown in U.S. Pat. No. 3,139,779 issued July 7, 1964 to Bredow.

Over the years, a number of different designs for such turret devices have evolved from single turret machines such as is shown in U.S. Pat. No. 1,743,070 issued Jan. 7, 1932 to Wetmore utilizing a horizontal axis turret to machines where a plurality of individual upper and lower turrets are mounted on a common drive turret such as is shown in Russian Pat. No. 253,547 of Nov. 23, 1970 to Ckyoa et al.

Some types of machine tools have been proposed wherein the turret table itself is equipped with dimensioned openings which directly receive the tool while other constructions provide turret table openings which receive tool holders, the holders each containing a tool. Additionally, it has been known to provide a turret table which is constructed of a number of parts and wherein the tools or tool holding members are clamped or otherwise nonpermanently fixed in place.

Further, it has been known to provide tool holders mounted on the turret with one or more of the tool holders carrying more than one tool such as for example U.S. Pat. No. 842,729 issued Jan. 29, 1907 to Vernat. In such multiple tool per holder constructions, the tools in each holder may operate in unison, as in U.S. Pat. No. 3,760,472 issued Sept. 25, 1973 to Kielma or they may be operated upon selectively, such as by moving the ram shown in U.S. Pat. No. 3,685,380 issued Aug. 22, 1972 to Daniels or by moving the tool holder as shown in U.S. Pat. No. 3,527,130 issued Sept. 8, 1970 to Knehans, or otherwise as shown in U.S. Pat. No. 3,951,026 issued Apr. 20, 1976 to Beauplat. See also German Auslegeschrift No. 1,302,423 of Oct. 22, 1970. It has been known to mount on an individual turret a plurality of combination work holders and tools. See for example U.S. Pat. No. 2,114,284 issued Apr. 19, 1938 to Barnes et al.

The prior art has a common deficiency relating to the changing of tools. For the most part, individual cooperating tools, such as punches in an upper turret and dies in a lower turret must be individually changed. Because they must be held securely during usage, they are either locked in place by means which require an unlocking action or, they are held in place by complex constructions.

Additionally, because the punches and dies are of different size, to the extent that the tools are held in holders which in turn are fixed to the turret, the holders must be cooperatively shaped. Normally this is accomplished so that a die holder having a given inner diameter will be able to receive a variety of different hole sized dies. However, for numerous reasons, including economics, small hole dies are manufactured with relatively small outer diameters. Thus the holders will be dimensioned to accept that outer diameter. For larger hole dies, larger outer diameters will be used and a tool holder must be provided having an inner diameter capable of receiving that larger outer diameter. Since the die holder is not normally removed from the turret when changing dies, the variety and arrangement of die sizes which can be provided on a given turret is determined by the die holders in place on that turret.

Since the die holder must be positively and accurately positioned with respect to the punch in order to accurately position the die with respect to the punch, any attempt to remove and replace the die holder in order to position a larger or smaller hole die at that station, will involve substantial machinery down time.

Thus, the prior art machines are restrictive in the variety of tools which can be easily and quickly substituted. An additional problem arises, particularly with punch turrets in that the larger the die hole, the larger the underlying opening in the turret must be in order to provide for material removal. Since the die holder is dimensiond with respect to that opening, only large dies can then be used above a large turret opening. Any attempt to use a smaller die holder will result in a lack of sufficient support for the die holder and therefore for the smaller die. In order to avoid this problem, it is desired to keep the number of large holes in any turret at a minimum. However, this then prevents set up of the machine for a job requiring a large number of large diameter dies. Heretofore, this problem has been met by increasing the size of the turret so as to increase the number of tools which can be carried thereby.

Another problem in evidence in prior art turret punching machines is the aforementoned difficulty in locating the tool holder with respect to the punch. This is frequently accomplished by positively indexing the upper turret to the lower turret and then by semipermanently affixing the die holder in position on the lower turret. Normally the die holder is so firmly fixed in position, as by means of a plurality of bolts or the like, that it becomes a substantial job to remove and replace, or to realign a die holder. Since indexing is normally checked by utilizing a shot pin which engages the turret, criticality of the positioning of the die holder on the turret is apparent. It would be an advance in the art to provide improved means of locating and positioning the dies.

Another disadvantage of prior art machine tools, and particularly turret punches resides in the access to the turrets which is offered for the purpose of changing tools. Access to the punches and to the dies has been quite restricted in the majority of prior art devices. Although it has been suggested to provide a segment of the work table, which normally surrounds at least a portion of the periphery of the lower turret, which can be dropped down to give access to the dies, see application of Franklin Smith titled "Die Changing Turret Table Segment", Ser. No. 587,392, which thereby gives greater access to the dies, this feature has not been integrated fully into a total die-punch changing concept.

Additionally, heretofore, when dies and punches were changed, it was possible that the punch could be separated from its associated die either during handling or storage. This creates a necessity for time consuming searches in order to be sure that a proper pair of die and punch are installed in the machine tool. Failure to install a proper pair can lead to both damage to the punch and the die, as well as damage to the work piece.

SUMMARY OF THE INVENTION

The present invention overcomes the numerous described disadvantages of the prior art and provides a machine tool having upper and lower turrets wherein at least one of the turrets is equipped with a plurality of tool holders, at least some of which hold a plurality of tools. The tool holders are themselves easily and quickly detachable from the turret, but, when in place, are firmly held on the turret in relatively fixed relation thereto. Additionally, the tools are fixedly held in the tool holder in fixed relation thereto.

Indexing means are provided for the turret and an alignment assemblage is provided which includes a form of shot pin which not only engages and determines the relative position of the turret but also engages and determines the relative position of the tool holder whereby correct positioning of the tool holder is specifically determined at the machine tool work station.

Relative simple access is provided for the removal of the tool holder by means of a vertically movable work table section which is actuated to move from a working level to a tool changing level in direct response to the opening of an access closure to the upper turret. Access to the upper turret is facilitated through the provision of a large peripheral opening in the embodiment illustrated.

In the preferred embodiment illustrated, the multitool work holder illustrated is a segment member which rests atop a lower turret and which is equipped with a plurality of die receiving openings dimensioned to receive individual dies and to hold them firmly in place with respect to the work holder.

The turret is equipped with a plurality of projecting T heads which index with T slots in the work holder. The T heads are extensible to a position above the turret surface at a point where, when they are indexed with the T slots, they will hold the tool holder above the surface. Either the turret or the tool holder is equipped with alignment pins which are alignable with an opening in the other of the turret or tool holder so that when the T head is withdrawn urging the tool holder against the surface of the turret, the pins will assure absolutely proper alignment of the tool holder with the turret.

Further, in the embodiment shown, both the periphery of the tool holders and of the turret is notched, the tool holder having at least one notch per tool. A mechanism is provided for insertion into a notch of the tool holder at the work station to determine if there is proper alignment of both the turret and the tool holder. The notch in the turret is used to determine accurate indexing of the turret both to the work station and to a tool changing station adjacent the table segment and access door.

Safety means are provided to prevent operation of the ram of the punch machine whenever a tool holder is not aligned at the work station, or wherever the access door is open.

It is therefore an object of this invention to provide an improved machine tool.

It is a more particular object of this invention to provide an improved double turret machine tool punch.

It is a general object of this invention to provide ease of and increased speed of tool change for machine tool punches.

It is another and more particular object of this invention to provide a machine tool turret punch wherein the lower turret is equipped with a plurality of die holders some of which holds a plurality of dies, the die holders being easily removable from the turret.

Another more and particular object of this invention is to provide a punch machine having upper and lower turrets wherein at least one of the turrets is equipped with tool holders which are easily removable from the turret, the turret and tool holders being provided with cooperating automatic means for insuring proper positioning of the tool holder with respect to the turret, the tool holders carrying a multiplicity of tools.

It is still another more particular object of this invention to provide a turret punch machine tool having a lower turret provided with stripping openings therethrough, a plurality of individual tool holders positionable on said turret above said stripping openings, each of said tool holders carrying a plurality of tools, projectable means extensible above and retractable towards a surface of the turret, the projectable means detachably detachable to the tool holders to hold the tool holders in place on the turret when in a retracted position and to allow easy removal of the tool holder when in the extended position, and means positively aligning the tool holder with respect to the turret.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a fragmentary perspective view of a double turret machine tool punch according to this invention.

FIG. 2 is a fragmentary sectional view of the machine tool of FIG. 1 from a position elevated above the upper turret.

FIG. 11 is a perspective view of a tool holder segment according to this invention.

FIG. 12 is a cross sectional view of the tool holder taken along the lines XV—XV of FIG. 11.

FIG. 13 is a top plan view of a tool holder according to this invention.

DESCRIPTION OF THE PREFERRED EMBODIMENTS

Figure 3:
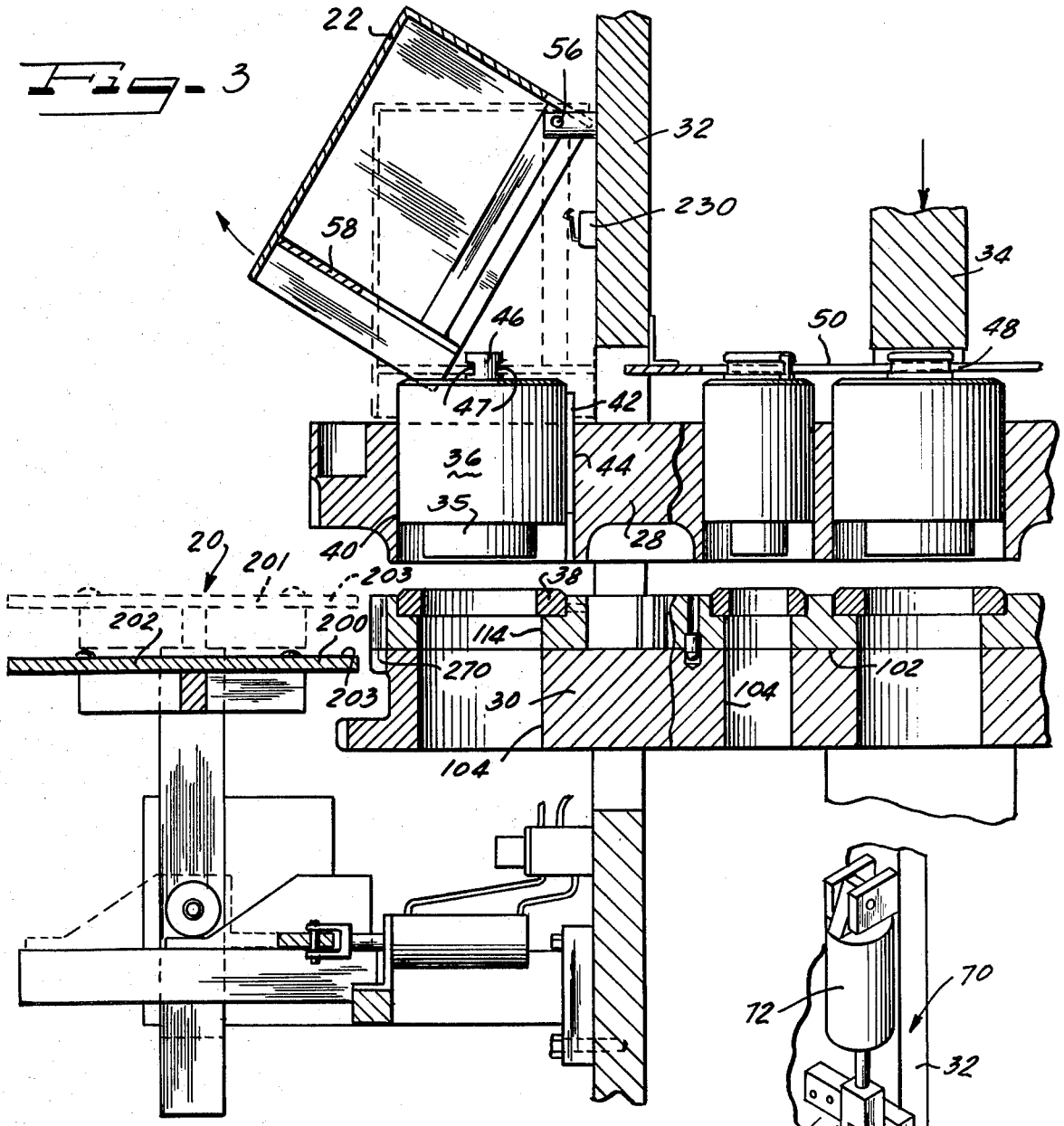
FIG. 3 is a fragmentary cross sectional view taken along the lines III—III of FIG. 2.

FIG. 1 illustrates a machine tool punch 10 which includes generally a shroud member 12, a control center 14, a work table 16, hydraulic work holds down 18, a work table segment 20 which is movable vertically and which, coupled with an access door 22 in the shroud, provides access to turrets 24. The work table 16 is equipped with roller members 26.

As best shown in FIGS. 2 and 3, the turrets 24 include upper turret 28 and lower turret 30 which are mounted for rotation on shafts 31 and 31*a* which in turn are secured in and held to main frame portions (not shown). Main frame portions 32 serve as a central core for the machine tool and support a ram 34 which is actuatable in vertical movement to cause movement of punches 35 received in punch holders 36. The punches are urged towards dies 38 carried by the lower turret. The punch holders 36 are received in openings 40 extending vertically through the upper turret 28, the punch holders being equipped with keys 42 received in key slots 44 in the openings 40 to properly index the punch holder, including its top projecting T head 46 with the turret. The T head 46 includes grooves 47 which receive tangs of a ram slot or groove 48 whereby the vertical movement of the ram will cause movement of the punch. Also the grooves 47 receive an edge 51 of a support plate 50 carried by the frame 32. The mating with the edge 51 of the support plate 50 maintains the punches in position in the openings 40 and prevents them from being mispositioned in the openings 40 so that they will be at the proper level with the tang walled groove 48 in the ram 34. The support plate 50 has an edge 51 which extends around approximately ¾ of the machine on the inner side of the punches. The access door 22 is equipped with its own support plate 58 which, because of the mounting of the hinge 56 attaching the access door to the frame or to the shroud, as the case may be, indexes with the groove 47 on the outside of the T head 46 when the access door is closed. However when the access door is in the open position illustrated in FIG. 3, there is nothing vertically above the punches to restrict their removal.

It should be appreciated that although a vertically swingable access door is illustrated in this embodiment, that horizontally swingable access doors can easily be substituted and that further, a large access door in a shroud wall can also be provided where the shroud is considerably larger than illustrated and extends outwardly to encompass the entire turret area. Thus it can be seen that when the door is in the closed position the edge 59 of the support plate 58 carried by the door will engage with the grooves 47 to maintain the punches at a proper level with respect to the support plate 50 so that as the turret is rotated the punches will be moved from the support plate 58 to the support plate 50, the support plates being stationary. The support plate 50 has a cut away portion 52 at the work station adjacent the ram so that as the T head of an individual punch moves into the ram slot 48 it is disengaged from the support plate. However as it moves out of the ram slot on the other side, it will re-engage the support plate.

The upper turret 28 has a plurality of shot pin openings 60 extending thereinto from atop thereof, the shot pin openings being aligned with the openings 40 receiving the punches, preferably on a turret radius line. A vertically actuatable shot pin assembly 70 is carried by the frame 32 and includes a frame mounted pneumatic or hydraulic cylinder 72 which actuates a pivot arm 74 which in turn is attached to the shot pin 76 through a double pivot linkage 78. The shot pin is guided for vertical movement in a fixed bushing 80 whereby movement of the shot pin is limited to a vertical movement only. The shot pin is positioned such that it lies immediately forward of the work station as illustrated in FIG. 2. This represents an improvement over the usual location of the shot pin on the opposite side of the turret from the work station which normal location produces a large moment arm allowing misalignment between the ram and the punch to occur. Because the shot pin indexes with the opening 60 immediately at the work station, perfect alignment of the turret opening 40 with the ram is assured.

Figure 5:
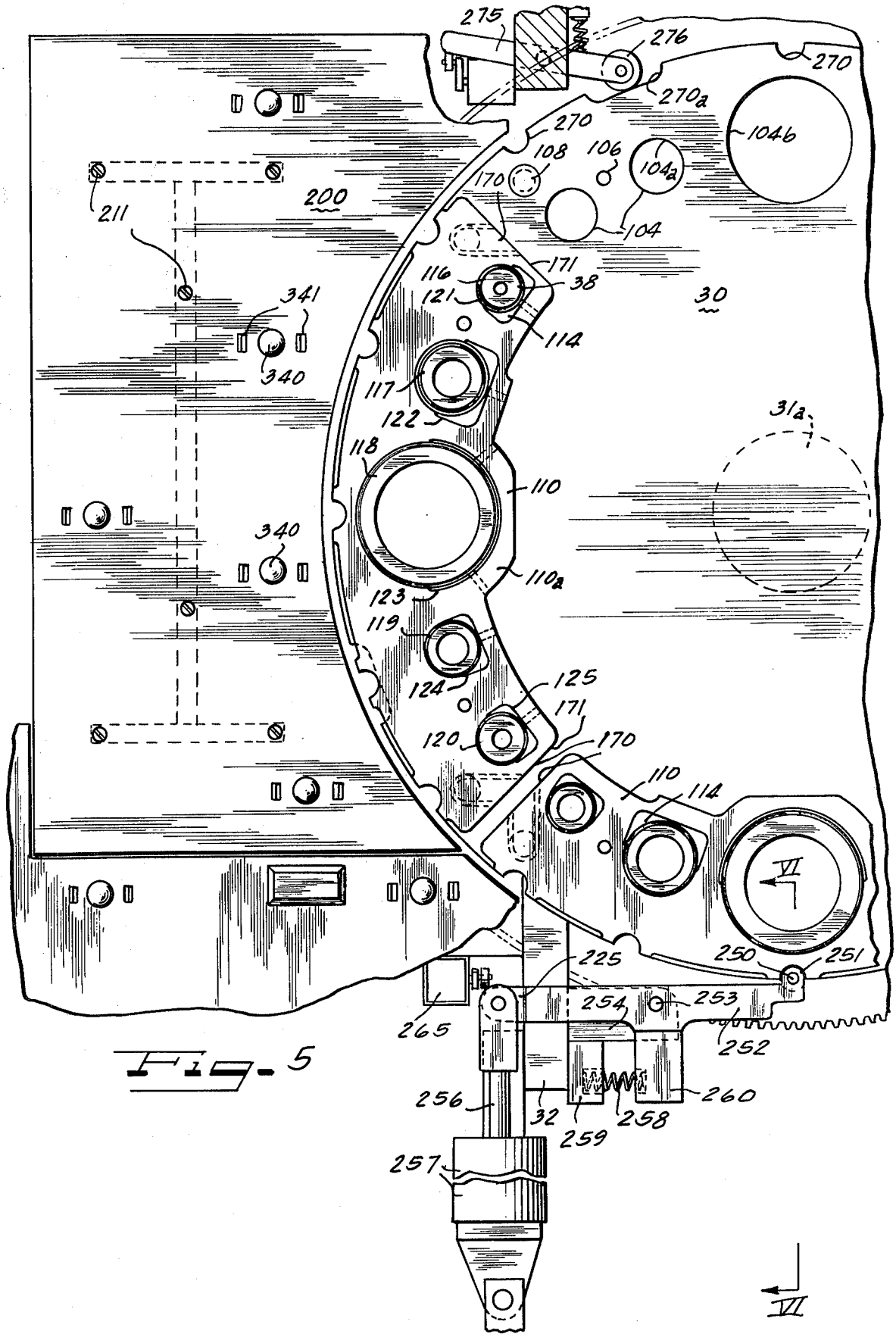
FIG. 5 is an enlarged fragmentary cross sectional view similar to the view of FIG. 2 taken on a section below the upper turret looking at the lower turret.

As best shown in FIGS. 3 and 5, the lower turret 30 is mounted for rotation on a central shaft 31*a*. The turret includes a table member having a top surface 102 cored by a number of slug openings 104 which extend through the turret and which allow material punched out of a work piece by a punch to fall through the lower turret to a disposal shoot. The turret is also provided with a plurality of alignment pin openings 106 and with T headed projectable members 108 best illustrated in FIG. 11.

A plurality of work holders or segments 110 are carried by the lower turret on the surface 102. The work holders 110 include a pluralityof dies 38 received in die openings 114. The work holder 110*a* shown in FIG. 5 has five such dies, 116, 117, 118, 119, and 120 received respectively in openings 121, 122, 123, 124 and 125. As illustrated in FIGS. 11 and 12, the openings 114 have an upper larger dimensioned area 125 which terminates in an internal inturned ledge 126 at a depth slightly less than the height of the die 38. A central waste disposal opening 128 extends downwardly through the work holder from the ledge. When the die 38 is received in the opening 114 it rests on the ledge 126. The ledge may be provided with a plurality of depressed areas 130 which are open to the opening 128 at their inner ends. The depressions 130 are for the purpose of keying shaped dies in relation to keyed punches.

As best shown in FIGS. 11 and 13 each opening 114 has an arcuate wall portion 131 which extends for approximately half the circumference of the associated die 38 and which mates the peripheral wall of the die substantially accurately. Thus when the die is urged against the arcuate surface 131, it will be perfectly seated within the work holder 110. In this manner, very accurate positioning of the die in the work holder is assured. The opening 114 is larger for the remaining half of the circumference of the opening in order to provide ease of removability of the individual dies. The dies are held in place by means such as set screws 133 which are received in threaded openings extending between the inner diameter of the tool holder and the opening 114. Preferably the set screws are on a diameter of the die which passes through the center point of the arcuate portion 131, which in turn, is preferably aligned with the turret center whereby the set screw lies on a radius of the turret. In the case of large dies two such set screws may be used spaced from one another.

The outer diameter 140 of the tool holder is arcuate and is dimensioned with respect to the curve of the turret periphery. The outer diameter is equipped with a plurality of vertically extending arcuate notches 141. Preferably there is one notch 141 for each die receiving opening 114. The center point of the notch 141 should preferably also lie on the same radius line, such as the line 142 illustrated in FIG. 13 as the set screw and the center point of the arcuate wall 131 of the openings 114. As is illustrated from a comparison of FIGS. 11 and 13, the openings 114 may be of various diameters thereby allowing a selection of differing sized dies in the same tool holder. In those machine tools where the lower turret always rotates with the upper turret, the openings 114 must be positioned on radius lines 142 which are positioned accurately with respect to punch openings 40 in the upper turret. However since a punch holder opening 40 can receive punches 35 of considerably varying diameter, whereas the opening 114 in a given tool holder 110 can only receive a given sized outer diameter die, for differing arrangements of punches received in the upper turret, differing tool holders will be provided for the lower turret.

One of the important features of this invention is the fact that although the lower turret is equipped with a number of slug openings 104 which correspond to the number of punch openings 40, and although the openings 104 may differ in size, as shown at 104*a* and 104*b* of FIG. 5, this does not restrict the size of the punches or dies. The opening sizes 104*a*, 104*b* in the lower turret are determined by the corresponding sized openings 40 in the upper turret. Thus, for example a 20 tool turret may have a 4 large diameter punch receiving openings in the upper turret and, correspondingly, 4 large diameter stripping openings in the lower turret. Because punches are received in punch holders, heretofore, it was possible to put a very small diameter punch in a large punch opening in the upper turret. However, it was not economically possible to put a small diameter die in position above the large diameter stripping opening in the lower turret. Not only would this require either changing the die holder, which was heretofore time consuming and has been relatively impractical, or it would result in the construction of a die having a small diameter opening and a very large, thick body so that the outer diameter might be fit in the tool holder designed to take a much larger diameter die. When such a die is constructed, it is extremely uneconomical and, more importantly, the tool holder would not provide sufficient support for the die since the force applied to the die is at the periphery of the die hole whereas the tool holder would be supporting the die at the outer periphery of the very wide die.

This problem is now substantially eliminated through the use of the quick change tool holders 110 which, because of their broad support on the turret surface 102 are themselves well supported and further, because the die is supported in a tool holder opening dimensioned to receive that die, the die is well supported. The thickness of the tool holder between the die support ledge 126 and the bottom 142 of the tool holder provides more than adequate stablity to the die. The fact that the individual stripping opening lying below that die may be much larger is of no practical significance.

FIG. 13 illustrates a tool holder 110*b* having the same spacing of die opening centers as the tool holder 110 of FIG. 11 but utilizing a plurality of smaller openings 114 and smaller dies. Thus where the tool holder of FIG. 11 is substantially symmetrical in the placement of the dies, this is not true in the tool holder of FIG. 13. Where the tool holder of FIG. 13 is mounted on the lower turret in the place of the tool holder of FIG. 11, the relatively small die 146 would be in the position normally occupied by the opening 148 of the tool holder of FIG. 11 which is equipped to carry a much larger die substantially as previously discussed. The die 146 is adequately supported in the tool holder while the tool holder itself is supported by its substantial area contact with the surface 102 of the turret 30.

Figure 9:
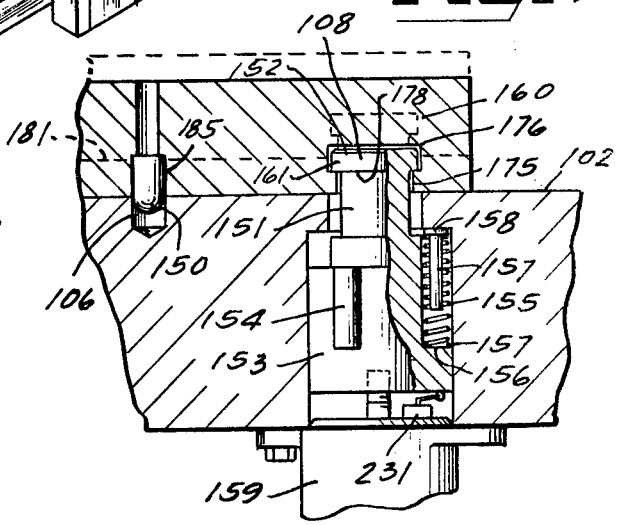
FIG. 9 is a fragmentary cross sectional view along the lines XI—XI of FIG. 8.
Figure 10:
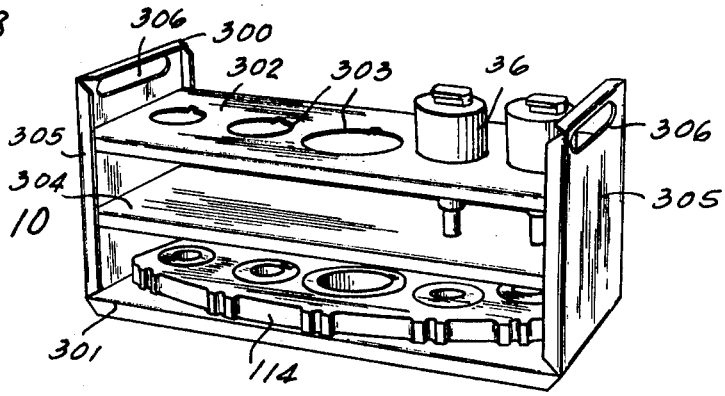
FIG. 10 is a perspective view of a carrying and storage rack for punches and die tool holders according to this invention.

The tool holders 110 are attached to the turret 30 by means of the projectable T headed members 108 and are properly aligned by means of locating pins 150. As best illustrated in FIG. 9, the T headed member 108 includes a shaft 151 which is topped with an enlarged diameter disc portion 152 giving an overall T shaped cross section. The shaft is carried by a piston member 153 which has a plurality of peripheral axially extending bores 154 having spring means 155 entrapped therein with one end of the spring bottoming on a ledge 156 of the piston 153 and the other end engaging an abutment member 157 which in turn engages an inturned ledge 158 of the turret 30 which in turn has a periphery defining an opening through which the shaft 151 is projectable. A hydraulic cylinder or the like 159 acts against the piston member 153 to urge the T head above the surface 102 to a point indicated by the dotted line 160. In the absence of pressure in the hydraulic cylinder 159, the springs 155 withdraw the T head to the position indicated by the bold lines 161 and maintain a spring bias further urging the T head to a withdrawal position towards the interior of the turret 30.

Figure 8:
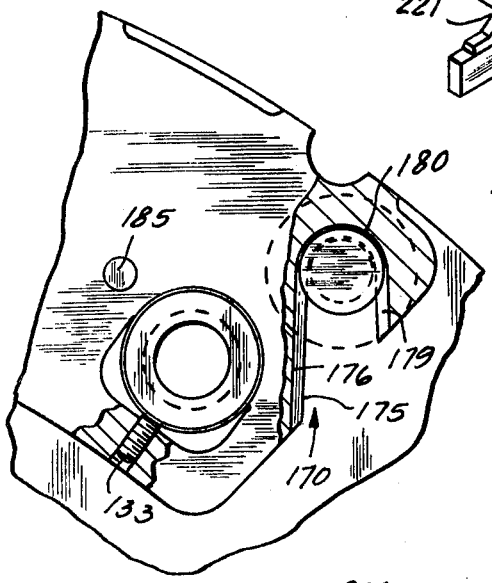
FIG. 8 is a fragmentary partially sectional view of a tool holder according to this invention showing the attachment to the turret.

As best shown in FIG. 8 and FIG. 5, each tool holder 110 is provided with T slots 170. The slots extend into the body of the tool holder 110 from a radius side wall 171 on a chord to the curve of the work holder. Each slot 170 has a relatively narrow throat opening 175 which may, for ease of insertion, have slightly non-parallel walls if desired. The throat opening is topped by a wider opening 176 which is dimensioned to receive the enlarged disc end 152 whereas the narrower throat opening receives the shaft 151. Thus the undersurface 178 of the disc contacts the ledge 179 formed at the intersection of the wide and narrow slot openings 175, 176. The blind end of the slot is preferably curved as at 180. Thus, when the T headed member is in its projected position illustrated by the dotted line 160, the segment will be lifted off of the surface 102 to the dotted position illustrated at 181. At this point, alignment pins 150 carried in pin openings 185 in the tool holder will be raised above the surface 102 and out of corresponding pin openings 106 in the turret 30. At that point, the tool holder can be slipped off of the turret by moving it radially outwardly. Insertion of a new tool holder is accomplished merely by substantially aligning the slots 170 with the T head projections in their raised position and thereafter moving the aligned tool holder radially inwardly with the T head extending into the slots.

Thereafter when the hydraulic or pneumatic pressure to the cylinder 159 is relieved the springs 155 will cause the T head projectable member to draw the tool holder towards the surface 102 of the turret where it will be properly aligned by the pins 150. In order to insure that the pins can cause slight movement of the work holder during the withdrawal of the projectable T headed members, one of the two pins for each tool holder is preferably formed with a diamond or pyramid shaped pointed end whereas the other is equipped with a rounded end. It is only necessary that the pins provide a slight movement because the tool holder will be substantially aligned due to the indexing of the T headed projections into the slots 170.

Figure 7:
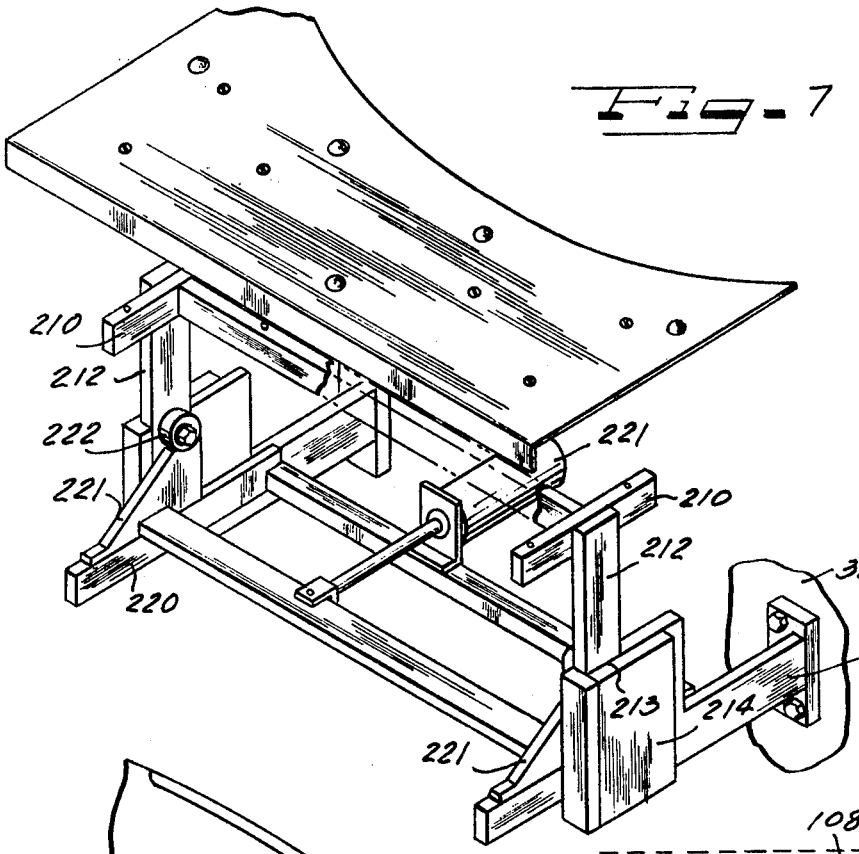
FIG. 7 is a perspective partially diagrammatic view of a vertically movable work table segment of the machine tool of FIG. 1.

In order to allow ease of insertion and withdrawal of the tool holders, the vertically movable table segment 20 is provided. As illustrated in FIG. 3, the table segment 20 includes a table top portion 200 which is movable from a work position 201 to a tool holder removal and insertion or die changing position 202. At the work position, the top surface 203 of the table top 200 is substantially aligned with the top of the turret 30 and is aligned with the top of the remainder of the work table 16. In the die changing position 202, the top 203 is positioned level with or slightly below the surface 102 of the turret whereby the tool holder can be moved radially outwardly straight onto the table segment 20. As best illustrated in FIGS. 5 and 7, the table segment has an underlying support frame 210 to which the table top 200 is securely fastened by means of screws 211 or the like. Frame 210 is carried by vertical beam members 212 which are slidably received in grooves 213 formed in a block member 214 supported by beams 215 attached to the frame 32. The beam 215 also supports a horizontally reciprocally movable frame slide 220 which is acted upon pneumatic or hydraulic cylinder 221 to move it towards and away from the vertical beams 212. The slide 220 is equipped with cam surfaces 221 which engage cam rollers 222 on the vertical beams 212. Thus, as illustrated in the drawing FIG. 7, when the pneumatic cylinder 221 moves the slide 220 outwardly, the rollers will rise up the inclinded cam surface 221 thereby moving the table segment to its work position 201. When the slide 220 is withdrawn, the table segment will drop downwardly to the die removal position. Preferably, the cylinder 221 is actuated by a micro switch 230 or the like which is engaged by the access door 22 in its closed position. Thus as soon as the access door 22 is opened, the turret table will drop from its standard or work position to the die changing position. When the access door is closed, the table will raise to the work position. In a preferred embodiment, another micro switch or the like 231 may be positioned to sense withdrawal of the T headed projectable members and prevent actuation of the turret table or of the micro switch 230 whenever the withdrawal is not completed. Actual withdrawal of the T headed member is actuated by termination of hydraulic or pneumatic pressure to the cylinder 159. This termination is in turn activated by closure of the micro switch 230. An interlock with the ram hydraulics prevents actuation of the ram 34 at any time when the micro switch 230 is open. This interlock can also be provided with the micro switch 231 and, if desired with a micro switch (not shown) determining the position of the work table segment. Thus a safety feature is provided preventing actuation of the machine tool at any time when the access door 22 is opened, or when the table is not in its work position or when any one of the projectable T headed members has not been withdrawn. A second interlock system is provided between the shot pin assembly 70 and the ram preventing actuation of the ram at any time the shot pin is not fully seated. Thus, if for some reason, the upper turret has failed to index properly and a punch is not precisely located with respect to the ram, the ram will be inoperable because the shot pin will not have seated.

Figure 6:
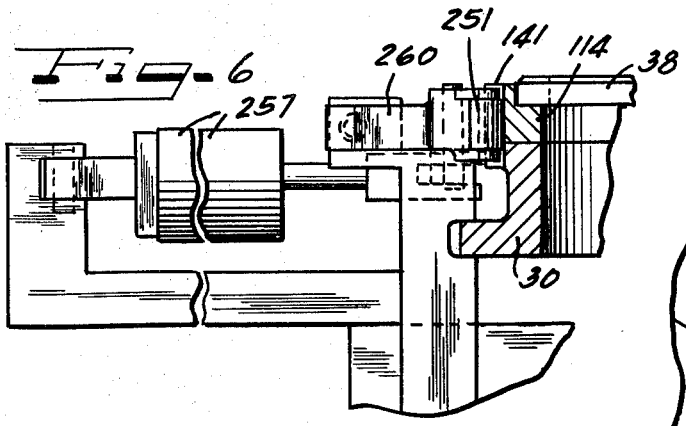
FIG. 6 is a fragmentary partially sectional view taken along the lines VI—VI of FIG. 5.
Figure 4:
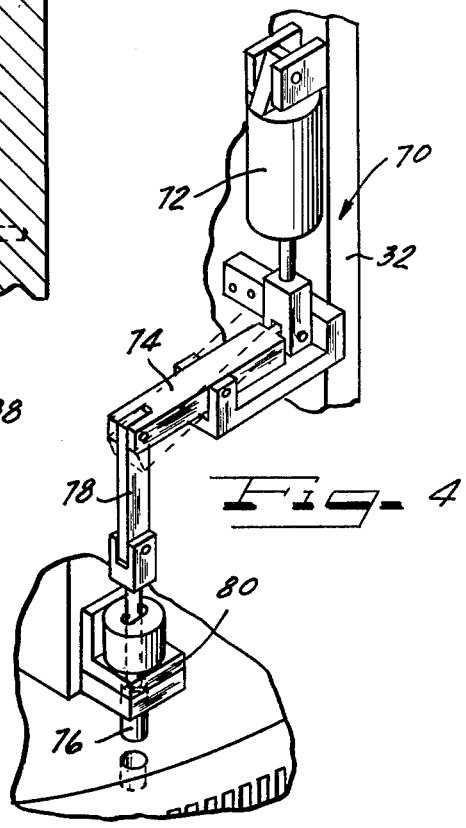
FIG. 4 is a fragmentary perspective view of an upper shot pin assembly for the upper turret.

The notches 141 of the individual tool holders are engageable by a shot roller 250 best illustrated in FIGS. 5 and 6. The shot roller has a roller member 251 positioned at the end of a pivotable arm 252 which is pivoted intermediate its ends as at 253 to a frame 32 carried extension 254. The opposite end 255 of the pivotable member 252 is engaged by the power arm 256 of a hydraulic or pneumatic cylinder 257. A spring 258 acts between a fixed abutment 259 and an abutment 260 formed as a part of the pivotable member 252. The spring urges the roller 251 towards the turret 30 whereas activation of the power arm 256 by the cylinder 257 causes withdrawal of the shot roller 251 from the periphery of the turret.

The shot roller is positioned on the machine tool at the side wall periphery of the lower turret immediately in front of the work station. The roller 251 is dimensioned with a curvature substantially equal to the curvature of the notches 141 which are at the front of the work holders and the periphery of the turret.

During indexing of the turret, the shot roller is withdrawn. When the turret indexing stops, the spring 259 will attempt to force the shot roller to its normal or rest position. A micro switch 265 senses whether the shot roller is in position. If it is not, the micro switch prevents power from being applied to the ram inasmuch as failure of the shot roller to return to its normal position under the influence of the spring indicates that the work holder is not in proper position.

As illustrated in FIG. 6, when desired, the shot roller 251 may have an axial length greater than necessary to read the notch 141 of the work holder and can also read a coextensive notch 270 in the periphery of the lower turret. Thus should no work holder be on the turret at the position of the work station, the shot roller can still determine whether the turret itself is properly positioned by either indexing with the notch 270 thereby indicating proper positioning or by failure to index and contacting the outer periphery of the turret thereby indicating a failure of proper positioning.

The notches in the turret also provide a method of determining where the turret is located. By making one notch **270*a* for each area of the turret to be aligned with a single work holder of larger circumferential direction and deeper than the remaining slots 270, a roller switch 275 having a roller on a different plane than the notches 270 can determine the position of the turret. By providing suitable control between the switch 275 and the turret drive motor, and proper positioning of the switch 275, it can be assured that the switch will indicate a predetermined position of the turret and terminate, when desired, rotation of the turret at that predetermined position. When the predetermined position is such that the entirety of one work holder will be aligned with the table segment 20, an automatic mechanism for indexing the table to a work holder removal position will have been provided. Thus a separate control on the control panel 14 can activate the stop motor circuit including the switch 275**. This will then cause rotation of the turret to the next tool changing position. Thereafter opening the access door will automatically cause the table segment to drop, the T head projectable members to extend thereby raising the work holder and providing a very simple and rapid tool changing possibility. Because the punch holders are normally relatively easily removable from the upper turret, the preferred embodiment illustrated shows only the use of a multi-tool holder in association with the lower turret.

In order to pre-program associated dies and punches, a storage rack 300 is provided. The storage rack includes a lower shelf 301 for receipt of a tool holder 114 and an upper shelf 302 is provided with a number of punch holder receiving openings 303 corresponding to the number and sizing of the die holders 36 which will work with the dies in the tool holder 114. A middle shelf 304 provides support for the punches and punch holders when received in the openings 303 of the upper shelf. Side walls 305 are provided with grasping handle openings 306 for transport of the member 300. Further the upper shelf openings 303 are notched to receive the alignment keys of the punches. It is to be appreciated that the member 300 can easily be rested on the table segment 20 when installing the tool holder 114 and the associated punch holders. It should be noted that the rack 300 illustrated is stackable, that is the side walls 305 have wide flat tops and the bottom of the shelf 301 is also flat.

It can therefore be seen from the above that our invention provides an improved turret machine tool wherein at least one of the turrets is provided with tool holders carrying a plurality of tools. Means are provided for ease of removability of the tool holders and additional means are provided for proper alignment of the tool holders when in position on the turret. Additionally turret and tool holder position sensing devices are provided and an interlock safety system is shown preventing actuation of the machine tool if the turret, tool holder, or turret access openings are not in proper position.

Further, our invention teaches a novel tool holder having design and dimension criteria which provide uniquely favorable results and which are inter-reactable with the unique tool holder alignment and turret-tool holder coupling devices shown.

We have also taught a unique die size interchangeability function which provides an ability to use small dies in association with large stripping openings in the turret while providing adequate support for the dies.

Although the teachings of our invention have herein been discussed with reference to specific theories and embodiments, it is to be understood that these are by way of illustration only and that others may wish to utilize our invention in different designs or applications.

We claim as our invention:

1. In a machine tool having a work station and at least one rotatable turret means carrying a plurality of individually utilized tools, the improvement of said turret means having a support portion, a plurality of individual tool holding members supported by said support portion, coupling means retaining said tool holding members in a relatively fixed position with respect to the support portion and the turret means for rotation with the turret means, at least some of said tool holding members receiving and accurately positioning with respect to the tool holding member a plurality of individual tools, means for assuring precise positioning of one of the tool holding members with respect to the work station when a given tool of the one tool holding member is positioned at the work station and said means for assuring positioning including reciprocatable means acting on the one of the tool holding members for assuring said precise positioning of the one of the tool holding members.

2. In a machine tool punch having upper and lower rotatable turrets with one of said turrets carrying a plurality of punches usable one at a time at a machine tool work station and the other of said turrets having a plurality of stripping openings therethrough, the improvement of a plurality of tool holders carried by said other turret, at least some of said tool holders carrying a plurality of dies usable one at a time at a machine tool work station, said some of said tool holders each spanning a plurality of said stripping openings, and said tool holders being quickly detachable from said other turret, and means for assuring precise positioning of one of the tool holders with respect to the work station when a given die of the one tool holder is positioned at the work station, said means for assuring precise positioning including reciprocatable means acting on the one of the tool holders for assuring and precise positioning of the one of the tool holders.

3. In a machine tool punch having upper and lower turrets with one of said turrets carrying a plurality of punches and the other of said turrets having a plurality of stripping openings therethrough, the improvement of a plurality of tool holders carried by said other turret, at least some of said tool holders carrying a plurality of dies, said some of said tool holders each spanning a plurality of said stripping openings, and said tool holders being quickly detachable from said other turret, wherein said quick detachability is provided by a plurality of extensible members carried by the other turret which are movable from a tool holder clamping position to a tool holder release position, the tool holders having configurations mating with the extensible members and the extensible members being indexable with said mating configurations of the tool holders whereby in the retracted position the extensible members will draw the tool holder into firm seated contact with the other turret.

4. The punch of claim 3 wherein alignment pins are carried by one of said other turret and said tool holders and are alignable with and insertable into mating openings of one of the other of said turret and tool holders, the alignment pins and said mating openings being positioned and dimensioned with respect to one another to accurately place the tool holder with respect to the turret when the extensible members draw the tool holder into firm seated engagement with the turret.

5. The punch of claim 4 wherein the tool holders are equipped with contoured surface interruptions and the machine tool is equipped with a shot locating device, the locating device movable between a contoured surface contacting and mating position and a contoured surface disengaged position, said shot member in the mating position engagable with the contoured surface of a tool holder assuring that a tool holder is properly positioned with respect to a work station of said machine tool.

6. The punch of claim 5 wherein the shot member, when in position engaging with the contoured surface of a work holder will simultaneously be positioned to index with a contour of the other turret, the other turret having a plurality of shot member indexable contours positioned on said turret to be aligned with contoured surface contours of tool holders carried by said other turret when the tool holders are properly positioned on said other turret whereby positioning of the shot member in contact with the contour of both a tool holder and an aligned contour of the turret assures that both the tool holder and the turret are in position with respect to the work station.

7. The punch of claim 6 wherein the tool holders are provided with means for fixably positioning tools thereon and the means assuring precise location of the tool with respect to the tool holder.

8. The punch of claim 7 wherein the contours of the tool holders include a plurality of circumferentially spaced apart axially extending notches with arcuate surfaces in radially outer periphery of the tool holder, and the shot member includes an arcuately surfaced member for mating with said notches.

9. The punch of claim 8 wherein the other turret has a plurality of circumferentially spaced apart arcuately surfaces axially extending radial notches in an outer periphery thereof and the shot member includes a roller end insertable into the tool holder notches and aligned other turret notches in seated contact with the arcuate surfaces.

10. The punch of claim 9 wherein the shot member is positioned substantially immediately forward of the work station and includes sensing means sensing whether the shot member is in complete tool holder and other turret contact position, and said sensing means preventing actuation of at least portions of said machine tool whenever the shot member is not in said position.

11. A machine tool punch comprising a frame member, upper and lower rotatable turrets carried by same frame member, means for rotating said turrets in unison, said lower turret having a plurality of stripping openings therethrough, a plurality of tool holders carried on said lower turret above said stripping openings, each of said tool holders having a plurality of tool receiving openings in a top surface thereof, said openings in communication with said stripping openings, each of said tool holders spanning a plurality of said stripping openings, at least some of said tool holders carrying a plurality of tools, said tool receiving openings contoured to exactly position a tool received therein, projecting means with head portions carried by said lower turret and movable between a tool holder release position where the head portions thereof are positioned at a first height above the top surface of said lower turret and a tool holder hold down position wherein said head portions are positioned at a second height closer to said top surface, means urging said projecting means toward said top surface when in the hold down position, contoured projecting head receiving openings in an undersurface of said tool holders, said projecting head receiving openings dimensioned to receive said head portions so that said head portions engage underlying portions of said tool holders whereby in the hold down position said tool holders are urged into snug seated contact with the top of said lower turret, alignment means cooperating between said tool holders and said lower turret whereby in the hold down positions said alignments means assure positive positioning of the tool holders on said turret top, and shot means contactable with portions of said tool holder only when said tool holder is in proper position on said lower turret to insure said proper positioning.

12. A die tool holder for the in machine tool turret punches comprising a body having top and bottom surfaces and inner and outer side walls, said outer side wall being arcuately curved, a plurality of die receiving openings in said top surface, said die receiving openings communicating with waste material disposal openings extending from said die receiving openings through said tool holder and open to said bottom surface, an inwardly extending ledge formed in the body of said tool holders at the juncture of each of said die receiving openings and waste disposal openings, said ledge forming a seat for a die received in said die receiving openings, said die receiving openings having a part cylindrical wall extending from said ledge to said top surface dimensioned to exactly mate with an outer diameter of a die received in said die receiving opening, a remainder of said wall extending from said ledge to said top surface being positioned at radial distance from a center of said die receiving opening greater than said part cylindrical wall providing clearance between said remainder of said wall, and a die received in said die receiving opening allowing easy removability of a die from said die receiving opening, means insertable through said remainder of said wall on a diameter line opposite at least portions of said part cylindrical wall, said means contactable with an outer diameter of a die received in said die receiving opening and effective to urge a portion of said outer diameter of said die into mating seated contact with said part cylindrical wall.

13. A turret punch machine comprising: upper and lower rotatable tool carrying turret members, a plurality of upper turret punch holder receiving openings, a plurality of lower turret waste disposal openings aligned with the punch openings, a plurality of punch holders having subsequently equal outer diameters and differing punch configurations interchangeably receivable in some of said punch holder openings, a plurality of die tool holders each carrying a plurality of dies, means for detachably attaching said die tool holders to said lower turret with each die overlying a waste disposal opening, each of the die tool holders overlying a plurality of said waste disposal openings and means for aligning the punches carried by the upper turret with dies carried by the lower turret at a work station, means for assuring precise positioning of one of the tool holders with respect to the work station when a given die of the one tool holder is positioned at the work station, said means for assuring positioning including reciprocatable means acting on the one of the tool holders for assuring said precise positioning of the one of the tool holders.

14. A machine tool turret punch having upper and lower rotatable turrets with one of the turrets carrying a plurality of die tool holders, the die tool holder arranged as segments of a ring, the ring underlying the punches carried by the one turret, means attaching each of the die tool holders to the one turret for rotation therewith, each of the die tool holders carrying a plurality of individual dies means attaching the individual dies to the die tool holders, and means for assuring accurate positioning of a selected one of the die tool holders with respect to a machine tool work station and additional means for assuring accurate positioning of the individual dies with respect to the die tool holder by which they are carried, said means for assuring accurate positioning including reciprocatable means acting on the one of the die tool holders for assuring said precise positioning of the said one of the die tool holders.

* * * * *

UNITED STATES PATENT AND TRADEMARK OFFICE

CERTIFICATE OF CORRECTION

PATENT NO. : 4,096,774

DATED : June 27, 1978

INVENTOR(S) : Harold Kaufmann

It is certified that error appears in the above—identified patent and that said Letters Patent is hereby corrected as shown below:

Column 2, line 40, for "dimensiond" read --dimensioned--.
Column 5, line 20, for "holds down" read --hold downs--.
Column 9, line 42, for "inclinded" read --inclined--.
Column 12, line 22, after "assuring" for "and" read --said--.
Column 13, line 19, for "surfaces" read --surfaced--.
Column 13, line 32, for "same" read --said--.
Column 13, line 60, for "alignments" read --alignment--.
Column 14, line 57, after "dies" (first occurrence) insert -- , --.

Signed and Sealed this

*Thirty-first* Day of *March 1981*

[SEAL]

*Attest:*

RENE D. TEGTMEYER

*Attesting Officer*

*Acting Commissioner of Patents and Trademarks*